US011815857B2

(12) United States Patent
Born et al.

(10) Patent No.: US 11,815,857 B2
(45) Date of Patent: Nov. 14, 2023

(54) HOROLOGICAL MOVEMENT PROVIDED WITH A GENERATOR AND A CIRCUIT FOR REGULATING THE FREQUENCY OF ROTATION OF THIS GENERATOR

(71) Applicant: The Swatch Group Research and Development Ltd, Marin (CH)

(72) Inventors: Jean-Jacques Born, Morges (CH); Philippe Sauvain, Chavornay (CH); Stéphane Perrier, Bernin (FR); Olivier Matthey, Mauborget (CH)

(73) Assignee: The Swatch Group Research and Development Ltd, Marin (CH)

( * ) Notice: Subject to any disclaimer, the term of this patent is extended or adjusted under 35 U.S.C. 154(b) by 153 days.

(21) Appl. No.: 17/455,758

(22) Filed: Nov. 19, 2021

(65) Prior Publication Data

US 2022/0179361 A1 Jun. 9, 2022

(30) Foreign Application Priority Data

Dec. 7, 2020 (EP) ..... 20212293

(51) Int. Cl.

| | |
|---|---|
| ***G04B 17/20*** | (2006.01) |
| ***G04C 3/06*** | (2006.01) |
| ***G04C 11/08*** | (2006.01) |

(52) U.S. Cl.

CPC ..... *G04B 17/20* (2013.01); *G04C 3/065* (2013.01); *G04C 11/088* (2013.01)

(58) Field of Classification Search

None

See application file for complete search history.

(56) References Cited

U.S. PATENT DOCUMENTS

| | | | |
|---|---|---|---|
| 3,937,001 | A | 2/1976 | Berney |
| 5,740,131 | A | 4/1998 | Bernasconi |

(Continued)

FOREIGN PATENT DOCUMENTS

| | | | |
|---|---|---|---|
| EP | 0 806 710 | A1 | 11/1997 |
| EP | 0 905 588 | A2 | 3/1999 |

(Continued)

OTHER PUBLICATIONS

European Search Report dated May 11, 2021 in European Application 20212293.3, filed on Dec. 7, 2020, 3 pages (with English Translation of Categories of cited documents).

(Continued)

*Primary Examiner* — Renee S Luebke
*Assistant Examiner* — Matthew Hwang
(74) *Attorney, Agent, or Firm* — Oblon, McClelland, Maier & Neustadt, L.L.P.

(57) ABSTRACT

A horological movement provided with a generator and a circuit for regulating the frequency of rotation of this generator, the regulation circuit being arranged to be able to detect the zero crossings of an induced voltage generated in the stator by the rotating rotor and to generate first braking pulses which are triggered after zero crossings and each end before the induced voltage reaches a peak value, preferably before the rectified induced voltage reaches a power supply voltage provided by a power supply capacity. In addition, the regulation circuit is arranged so as to be able to further generate second braking pulses each of which occurs after detection of the end of a charging period of the power supply capacity during which the induced voltage reaches a peak value and each end before the induced voltage crosses zero.

5 Claims, 2 Drawing Sheets

(56) References Cited

U.S. PATENT DOCUMENTS

| | | | |
|---|---|---|---|
| 6,034,502 | A | 3/2000 | Bühler |
| 6,414,909 | B1 | 7/2002 | Shimizu et al. |
| 2001/0046188 | A1 | 11/2001 | Koike et al. |
| 2020/0073331 | A1 | 3/2020 | Tombez |

FOREIGN PATENT DOCUMENTS

| | | | |
|---|---|---|---|
| EP | 0 905 588 | A3 | 3/1999 |
| EP | 1 063 573 | A1 | 12/2000 |
| EP | 3 620 867 | A1 | 3/2020 |
| JP | 50-6373 | A | 1/1975 |
| JP | 11-64545 | A | 3/1999 |

OTHER PUBLICATIONS

Office Action dated Nov. 22, 2022, in corresponding Japanese Patent Application No. 2021-191775 (with English Translation), 11 pages.

HOROLOGICAL MOVEMENT PROVIDED WITH A GENERATOR AND A CIRCUIT FOR REGULATING THE FREQUENCY OF ROTATION OF THIS GENERATOR

CROSS-REFERENCE TO RELATED APPLICATION

This application claims priority to European Patent Application No. 20212293.3 filed on Dec. 7, 2020, the entire disclosure of which is hereby incorporated herein by reference.

TECHNICAL FIELD

The invention relates to the field of horological movements which are provided with a generator and a circuit for regulating the frequency of rotation of this generator.

More particularly, the invention relates to a horological movement comprising a barrel, an analogue time display mechanism driven by at least one barrel and a running regulator module of the analogue display mechanism. The regulator module comprises a continuously rotating generator and a circuit for regulating the angular speed or, equivalently, the frequency of rotation of this generator, that is to say of its rotor. More specifically, the regulation circuit is arranged to be able to regulate the average frequency of rotation of the rotor, which is also driven by said at least one barrel and kinematically connected to the analogue display mechanism so that the regulator module can regulate its running. In addition, the generator is intended as a source of electrical energy for a power supply circuit of the regulation circuit.

TECHNOLOGICAL BACKGROUND

A horological movement of the type mentioned in the technical field is described in document EP 935 177, which refers to document CH 686 332. As indicated in this document, as long as the barrel intended to drive the horological movement, namely at least the time display mechanism and the generator, has a winding rate corresponding to a normal operating range of this horological movement (including the indicators associated therewith), the generator rotates too fast in the absence of braking, that is to say that its rotor rotates freely with a speed greater than a set speed or, in an equivalent manner, with a frequency greater than a set frequency. The regulation circuit is associated with a quartz oscillator which allows to determine the set frequency with a precision specific to the quartz oscillator. The regulation circuit comprises a measuring circuit allowing to measure the rotation of the rotor over time and thus to detect a drift in the average frequency of rotation of the generator relative to the set frequency determined by the quartz oscillator. Then, the regulation circuit is arranged to be able to generate braking pulses of the rotor by momentarily reducing the impedance at the terminals of at least one coil of the generator so as to brake the rotor, when the drift of the average frequency of rotation is greater than a given positive value, to correct this drift. In addition, the regulation circuit is arranged to be able to detect the zero crossings of an induced alternating voltage generated in said at least one coil by the rotating rotor and to generate braking pulses which are triggered respectively after the detection of zero crossings of this induced alternating voltage (hereinafter 'induced voltage').

FIG. 1 shows a graph of the voltage induced at the two terminals of a stator of a generator of the type considered here. The sinusoidal curve 2 (partially in dotted lines) corresponds to the voltage induced at the terminals of the stator, formed of at least one coil, when the permanent magnet rotor of the generator rotates substantially with the set angular speed. The digital signal 4 represents the control signal of a switch arranged between the terminals of the stator, the state '1' indicating a closing of the switch (switch on) which generates a short-circuit of said at least one coil. Each short-circuit has the consequence that the voltage at the terminals of the stator, represented by the curve 6, drops substantially to zero. Each momentary closing of the switch generates a braking pulse on the generator allowing to limit its speed of rotation in order to be able to maintain it on average at a set angular speed.

As can be seen in FIG. 1, each braking pulse is triggered rapidly upon detection of a zero crossing of the induced voltage and the duration of each braking pulse is scheduled so that it ends well before the induced voltage reaches a peak value after the zero crossing used to trigger this braking pulse. Preferably, the duration of each braking pulse is scheduled so that it ends before the rectified induced voltage reaches the value of a power supply voltage intended for a power supply capacity recharged by the generator. Each braking pulse thus has a maximum duration T1 allowing to ensure that the generator can, in normal operation of the horological movement, fulfil its function of electrical energy source for the regulation module and for this purpose recharge a power supply capacity in each half-period of the induced voltage signal. Thus, a single braking pulse with a limited duration, for example at most one sixth of a period T0 of this signal (T1=T0/6), is provided in each half-period of the induced voltage signal after the induced voltage signal crosses zero. Although braking pulses can be applied to the generator with a frequency equal to twice that of the induced voltage signal, the braking power is however limited. This fact has the consequence that the normal operating range of the horological movement is limited, because the force torque applied continuously to the generator must be limited so that the useful part of the mechanical power for driving this generator (the useful part being that available at the rotor acceleration) remains less than the maximum braking power. As the horological movement is generally provided with an internal mechanical energy source, namely it comprises one or more barrel(s), limited braking power results in a limited power reserve.

SUMMARY OF THE INVENTION

The object of the present invention is to overcome the aforementioned problem by proposing a horological movement of the type described above which allows a wider operating range for the torque that can be provided by the barrel(s) and thus a greater power reserve.

To this end, the invention relates to a horological movement comprising a barrel, an analogue time display mechanism and a regulator module for regulating the running of the analogue display mechanism comprising a continuously rotating generator and a regulation circuit, the generator being formed of a rotor with permanent magnets rotated by the barrel and comprising at least one coil, forming a stator, which is connected to the regulation circuit, which is arranged to be able to regulate the average frequency of rotation of the rotor. Then, the horological movement comprises a power supply circuit connected to said coil and intended to power supply the regulation circuit, this power supply circuit comprising a rectifier for rectifying the induced alternating voltage and a power supply capacity which is recharged, by the voltage induced via the rectifier, during charging periods in each of which said induced voltage reaches a peak value. In addition, the regulation circuit is arranged to be able to measure the rotation of the rotor over time and thus detect a drift in the average frequency of rotation of the generator relative to a set frequency, determined by an electronic oscillator associated with the regulation circuit, and/or a variation in the frequency of rotation, and to be able to generate braking pulses of the rotor by momentarily reducing the impedance at the terminals of said at least one coil, so as to brake the rotor according to said drift and/or said variation to regulate the speed of rotation of the generator and thus the operation of the analogue display mechanism. The regulation circuit is arranged to be able to detect the zero crossings of an induced alternating voltage generated in said at least one coil by the rotating rotor and to generate first braking pulses which are each triggered after a detection of a zero crossing of the induced voltage, the duration of each first braking pulse being scheduled so that it ends before the induced alternating voltage reaches the peak value after the zero crossing used to trigger this first braking pulse. According to the invention, the regulation circuit is arranged so as to be able to further generate second braking pulses which are each triggered after a detection of the end of one of the charging periods of the power supply capacity and each of which has a duration scheduled for each second braking pulse to end before the induced alternating voltage crosses zero.

In a preferred variant, each first braking pulse is provided so that it ends before the induced alternating voltage reaches, in absolute value, the value of the power supply voltage of a power supply capacity intended for the power supply of the regulation circuit. Charging period of the power supply capacity, means both a period of direct recharging of this power supply capacity and a period of recharging of an additional capacity incorporated in the rectifier and which momentarily stores electrical energy produced by the generator, this electrical energy then being transferred to the power supply capacity, in particular in a following half-period of the induced voltage.

Thanks to the features of the invention, the braking power of the generator can be increased by means of the generation of the second braking pulses, without disturbing the recharging of the power supply capacity by the generator and without preventing the detection of the zero crossing of the induced voltage signal, allowing to count a number of revolutions made by the rotor in order to be able to determine the almost instantaneous frequency of the generator and also its average frequency over time so as to be able to ensure, via a regulation of the speed of rotation of the generator, a high precision in the indication of the current time when the horological movement operates continuously. In a preferred embodiment, the invention allows to generate two first braking pulses and two second braking pulses, to brake the generator, in each period of the signal of the voltage induced in the stator of this generator by the rotating rotor.

BRIEF DESCRIPTION OF THE FIGURES

The invention will be described in more detail below using the appended drawings, given by way of non-limiting examples, wherein.

DETAILED DESCRIPTION OF THE INVENTION

Figure 1:
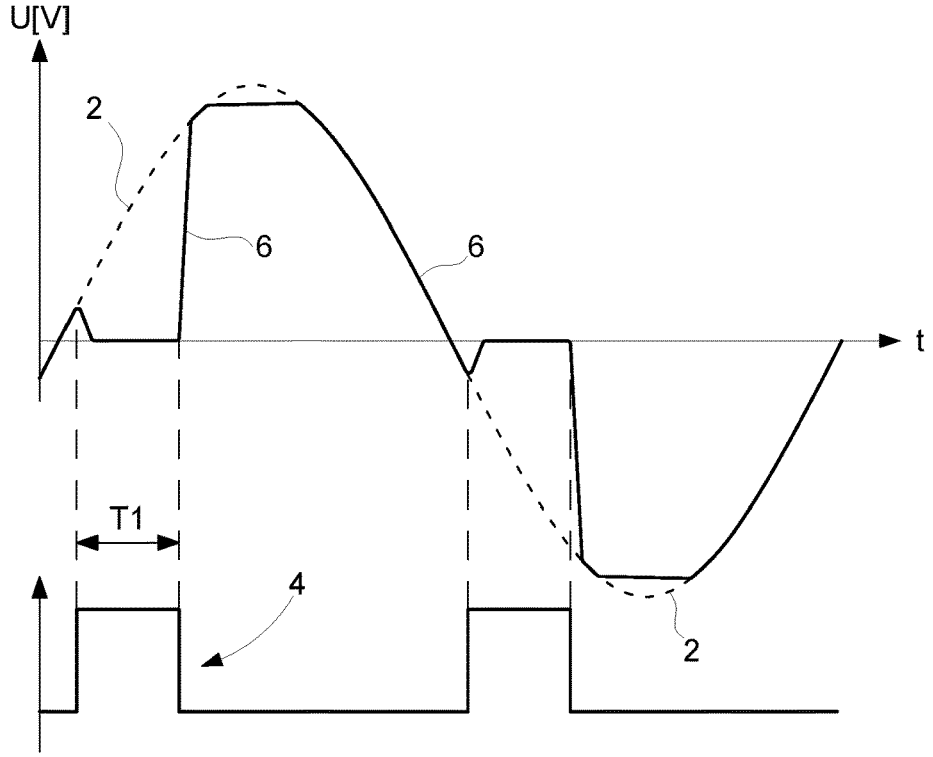
FIG. 1, already described, shows the voltage induced in at least one coil of the stator of a horological-type generator and the voltage at the terminals of said at least one coil when the speed of rotation of the generator is regulated, with a maximum braking power according to the prior art, by braking pulses, via a short-circuit of said at least one coil, each occurring within the first half of each half-period of the induced voltage signal.
Figure 2:
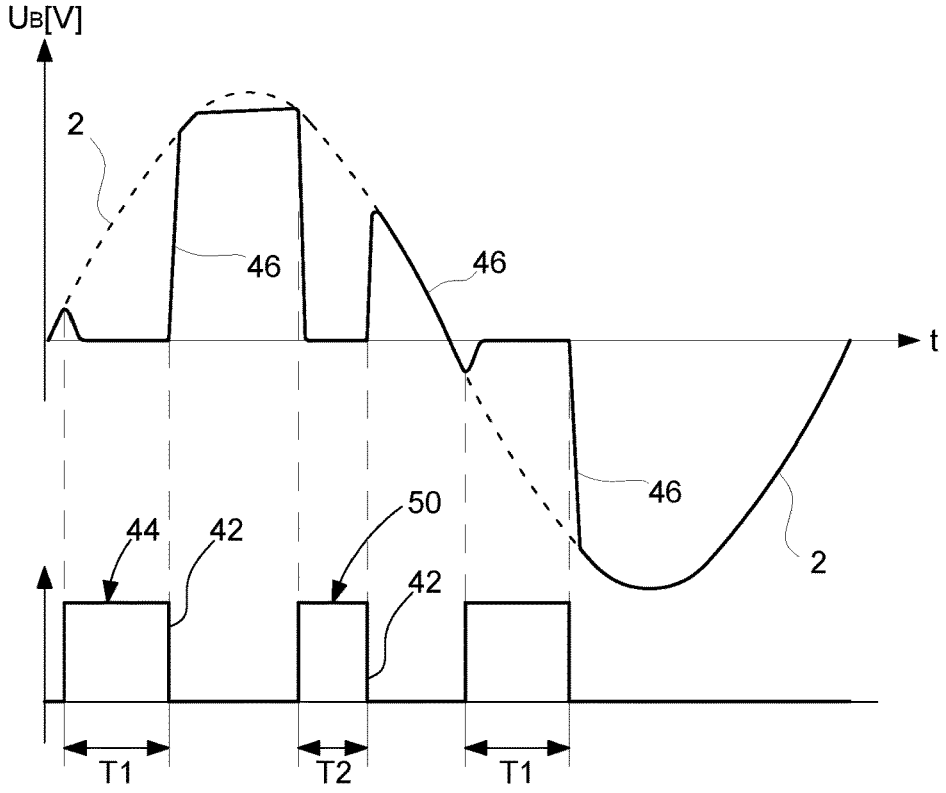
FIG. 2 shows the voltage induced at the terminals of the stator of a horological-type generator and the voltage between these terminals when the speed of rotation of the generator is regulated according to the invention with a braking power increased by means of braking pulses, via a short-circuit of at least one coil forming the stator, each of which occurs within the second half of a half-period of the induced voltage signal.
Figure 3:
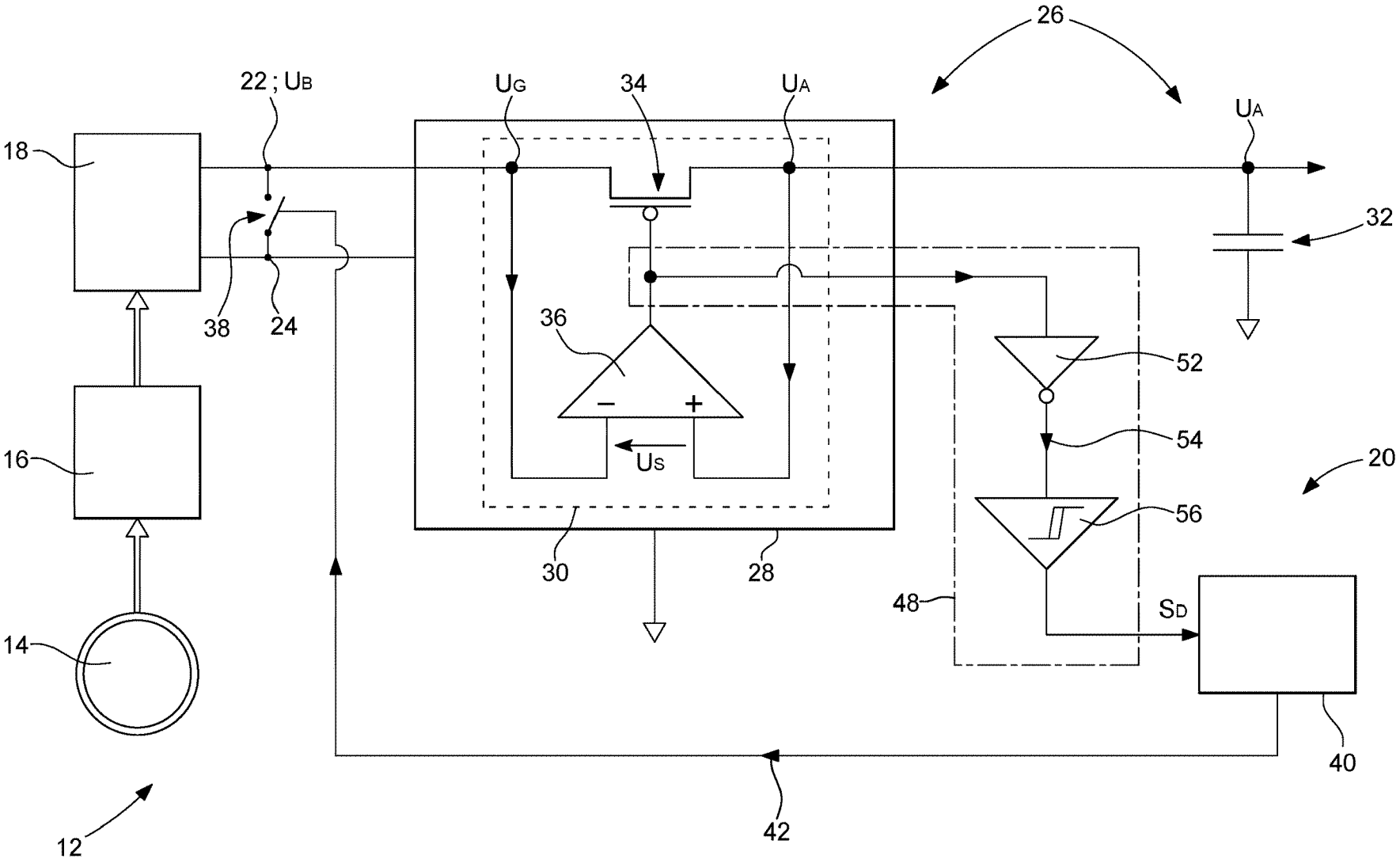
FIG. 3 schematically and partially shows a first embodiment of the horological movement according to the invention.

With reference to FIGS. 2 and 3, a first embodiment of a horological movement 12 according to the invention will be described. In general, the horological movement 12 comprises a barrel 14, an analogue time display mechanism 16 arranged to be able to drive the current time indicators (not shown) and a regulator module for regulating the running of the analogue display mechanism comprising a continuously rotating generator 18 and a regulation circuit 20. The generator is formed, in known manner, of a rotor with permanent magnets rotated by the barrel and of a stator comprising at least one coil connected to the regulation circuit, which is arranged to be able to regulate the average frequency of rotation of the rotor. In the variant shown in FIG. 3, the generator comprises one or more coil(s) of the "wafer" type (in the shape of a flat disc having a circular or other outer profile, for example a trapezoidal profile). In the case of a plurality of coils, the latter are connected in series or in parallel so that the stator has two terminals 22 and 24.

The horological movement comprises a power supply circuit 26 connected to the stator and intended to power supply the regulation circuit. This power supply circuit comprises a 'half-wave' rectifier for rectifying the induced alternating voltage generated by the rotor rotating in the coil(s) of the stator, this rectifier being formed of an active diode 30, and a power supply capacity 32 which is charged by the induced voltage via the active diode. It will be noted that the rectifier can further comprise a voltage booster. The rectifier thus receives at input a voltage $U_B$ corresponding to the voltage at the terminals of the stator and it provides at the output to the active diode a rectified voltage $U_G$ corresponding to the rectified induced voltage (in the absence of a short-circuit between the terminals of the stator). The active diode 30 is formed of a transistor 34 and a comparator 36, the output of which controls the transistor, this active diode being arranged by construction so as to be conductive when the input voltage $U_G$ is greater than the output voltage $U_A$ increased by a predetermined threshold voltage $U_S$ ($U_G > U_A + U_S$), and so that, when the active diode is conductive, the voltage drop across the transistor is greater than the threshold voltage. The voltage $U_A$ is the power supply voltage provided by the power supply capacity 32. The threshold voltage $U_S$ for example has a value comprised between 10 and 20 mV. This threshold voltage is obtained by an asymmetrical construction of the comparator 34 (known technique).

The regulation circuit is arranged to be able to measure the rotation of the rotor over time and thus detect a drift in the average frequency of rotation of the generator relative to a set frequency, determined by an electronic oscillator associated with the regulation circuit, and/or a variation in the frequency of rotation, and to be able to generate braking pulses of the rotor by momentarily reducing the impedance at the terminals of the stator, so as to brake the rotor according to the measured drift and/or the detected variation to regulate the speed of rotation of the generator 18 and thus the operation of the analogue display mechanism 16. The measurement of the rotation of the rotor can advantageously be carried out, in a known manner, by detection of the zero crossings of the induced voltage signal 2 at the stator terminals (see FIG. 2). The circuit for measuring the rotation of the rotor and the oscillator of the electronic type (generally a quartz oscillator) are known and have not been shown in FIG. 3. In the variant shown, the braking pulses are generated by means of a switch 38 which is arranged between the terminals 22, 24 of the stator, this switch being controlled by a control unit 40 which closes the switch during distinct time intervals in order to generate the braking pulses by short-circuiting. The control unit 40 is part of the regulation circuit and it provides a digital control signal 42 to the switch 38 according to various regulation parameters specific to the planned regulation method. Thus, in particular according to the measured drift and/or the variation detected in the rotation of the rotor over time, the control circuit 40 generates more or less braking pulses.

The object of the present invention, as already explained, is to allow an increase in the braking power of the generator without harming its function of power supplying the regulation circuit and without preventing detection of zero crossings of the induced voltage in the stator of the generator, this detection being useful for measuring the rotation of the rotor and also for generating, in a known manner, first braking pulses, corresponding to the first control pulses 44 which generate them, which are triggered after the detection of zero crossings of the induced voltage signal.

When the switch is on/conductive, the voltage $U_B$ at the terminals of the stator, represented by the curve 46 in FIG. 2, becomes substantially zero and the induced voltage can no longer be measured. For this reason, the duration T1 of each first control pulse 44 is scheduled so that the first braking pulse which results therefrom ends before the induced voltage reaches a peak value after the zero crossing which was used to trigger this first braking pulse, that is to say within a first half of a half-period of the induced voltage signal 2. Preferably, the duration T1 has a maximum value ensuring that each first braking pulse ends before the induced voltage reaches a value equal to a power supply voltage $U_A$ provided for the power supply of the regulation circuit (see FIG. 2), to allow optimum charging periods of the power supply capacity, that is to say as long as possible. The recharging of the power supply capacity by the generator generates in the voltage signal $U_B$ at the output of the stator, respectively in the voltage signal $U_G$ at the output of the rectifier 28, substantially flat areas corresponding to the charging periods of the power supply capacity during which the active diode is on/conductive. The induced voltage and the rectified induced voltage respectively reach a peak value and a maximum value during each charging period.

According to the invention, the regulation circuit 20 is arranged so as to be able to generate, in addition to the first braking pulses, second braking pulses, corresponding to second control pulses 50 which generate them, by momentarily reducing the impedance at the terminals of the stator, which is done by short-circuiting these terminals by closing the switch 38 as for the first braking pulses. The second braking pulses each occur after the induced voltage crosses a peak value, namely in a second half of a half-period of the induced voltage signal, and each end before the induced voltage crosses zero according to this peak value. More specifically, provision is made for each second braking pulse to occur after the end of a charging period of the power supply capacity 32, so as not to limit this charging period and thus not to reduce the efficiency of recharge of the power supply capacity by the generator. To this end, the regulation circuit 20 comprises a detection circuit 48 allowing to detect the charging periods, during which the active diode 30 is on/conductive and the power supply capacity is thus recharged, and more particularly to detect the end of these charging periods.

The detection circuit 48 provides a digital detection signal $S_D$ indicating the state of the active diode 30 to the control unit 40 which manages the impedance at the terminals of the stator, this control unit being arranged to be able to trigger, by the rising edge of a second control pulse 50, a second braking pulse as soon as the signal $S_D$ has a transition indicating the end of one of the charging periods. Thus, the rising edge of each second pulse 50 of the control signal 42, generating a second braking pulse, advantageously follows almost instantaneously the detection of the end of one of the charging periods during which the power supply capacity is recharged.

The detection circuit 48 comprises an amplifier and inverter 52 receiving at input the output signal of the comparator 36 supplied to the transistor 34 of the active diode 30. It will be noted that the transistor 34 is produced in P-type MOS technology (PMOS). Thus, this transistor is conductive when the output signal of the comparator is in the 'low' state. As this comparator receives the rectified voltage $U_G$ of the generator on its negative terminal and the power supply voltage $U_A$ on its positive terminal, its state is 'low' and the transistor is then on when $U_G > U_A + U_S$. Thus, during each charging period when the generator recharges the power supply 32, the comparator 36 provides a 'low' signal and, when this charging period ends, the output signal of the comparator switches from the 'low' state to the 'high' state and the analogue signal 54 at the output of the inverting amplifier 52 switches from the 'high' state to the 'low' state. The detection circuit 48 further comprises an analogue-to-digital converter 56 (A/D converter) with hysteresis, in particular of the "Schmitt trigger" type, arranged after the inverting amplifier. This A/D converter provides the digital detection signal $S_D$ to the control unit 40, allowing the latter to receive the information of the end of each charging period of the power supply capacity by the detection of a change of value in the signal $S_D$.

In the represented variant of the detection circuit, the end of a charging period occurs when the value of the signal $S_D$ switches from the value '1' to the value '0' (falling edge in the signal $S_D$). In a variant where the amplifier is not associated with an inverter, it is therefore the transition between the value '0' and the value '1' of the signal $S_D$ (rising edge) which indicates the instant at which a charging period ends. As already indicated, as soon as the ending instant of a charging period is detected by the control unit and if the regulation method requires a second braking pulse at this moment, the control unit generates a second control pulse 50 the rising edge of which (case where the control pulses are given by the value '1' of the control signal 42) is almost simultaneous with the detected ending instant of a charging period. The duration T2 of every second control pulse 50 is scheduled so that the resulting second braking pulse ends before the induced voltage reaches the zero value, so that this second braking pulse is within a second half of a half-period of the induced voltage signal 2 (see FIG. 2). Note that FIG. 2 shows only one period of the induced voltage 2 in the stator and of the voltage $U_B$ at the terminals of the stator of the generator 18, as well as three control pulses generating three braking pulses during this period, namely two first braking pulses and a second braking pulse which occurs in the positive half-period of the induced voltage as allowed by the first embodiment described above with a "half-wave" rectifier.

It will be noted that in the context of the first embodiment, in so far as the sign of the induced voltage after each zero crossing of the induced voltage is known, it is possible to increase the duration of the braking pulses occurring in the negative half-periods of the induced voltage and thus considerably increase the braking power by third braking pulses each of which starts before an instant when the induced voltage crosses an extreme negative value and ends after this instant. The duration of the third braking pulses is in particular greater than a quarter of a period of the induced voltage. However, depending on the technology used and the electronic circuit provided, recharging the power capacity by the generator requires that this power capacity be recharged in each half period of the induced voltage. For this purpose, provision is made of a second preferred embodiment of the invention (not shown) in which is arranged a 'full-wave' rectifier formed, in a known manner, with two active diodes, advantageously one active PMOS diode which becomes conductive during the positive half-periods and an active NMOS diode (which becomes conductive during the negative half-periods of the induced voltage. The PMOS diode (also used in the first embodiment) is also arranged between the terminal 22 of the generator and the positive terminal $V_{DD}$ of the power supply capacity delivering the voltage $U_A$. This PMOS diode is associated with a detection circuit 48 similar to that shown in FIG. 3. The NMOS diode is arranged between the terminal 22 of the generator and the negative terminal $V_{SS}$ of the power supply capacity. This NMOS diode is arranged in the rectifier so as to become turned on when $U_G$ is less than minus $U_S$ (that is to say $U_G<-U_S$). In addition, an additional capacitor (the value of which is generally slightly less than half the power supply capacity) is arranged between the terminal 24 of the generator and the terminal $V_{DD}$ of the power supply capacity 32. This additional capacity is charged during positive half-periods when the PMOS diode is conductive and discharged during negative half-periods when the NMOS diode is conductive, the transfer of energy to the power supply capacity occurring only once per period of the induced voltage, but with a transferred energy approximately equal to twice that transferred in the first embodiment. A second detection circuit, similar to the first one associated with the active PMOS diode, is provided. This second detection circuit is arranged to provide a detection signal to the control unit allowing it to detect in the negative half-periods of the induced voltage when the charging period of the power supply capacity ends, that is to say when the active NMOS diode switches from a conductive state to a non-conductive state, thus allowing to generate in these negative half-periods also second braking pulses according to the invention.

It will be noted that the present invention allows to regulate the speed of rotation of the generator 18 over a wide range of a force torque applied to the rotor of this generator, this range ranging substantially from a torque useful for the normal operation of the horological movement at a maximum torque still allowing to regulate the operation of the display mechanism 16 by the regulation module according to the invention. When the torque is minimal, that is to say that no braking pulse is theoretically necessary to maintain the rotation of the generator at a set speed in a stable situation, then there is in fact no more regulation so that practically the torque useful for proper operation of the horological movement is slightly greater than such a minimum torque. In the second embodiment, when the force torque is maximum, the regulation of the angular speed of the rotor of the generator requires generating a first braking pulse and a second braking pulse in each half-period of the induced voltage, these first and second braking pulses each having a respective maximum duration. Between these two extreme values of the force torque, there are several possible options for regulating the average frequency of the generator. It is in particular possible to start by reducing the duration of the first braking pulses and/or of the second braking pulses. It is also possible to start by periodically eliminating/inhibiting a first braking pulse and/or a second braking pulse. In a particular variant where the number of second braking pulses per unit of time when the force torque decreases from its maximum value is first gradually reduced, at a certain moment an intermediate force torque is reached for which, in stable operation of the generator, only the first braking pulses are required. As the force torque continues to decrease, the duration and/or frequency of the first braking pulses in turn decrease(s). It is therefore understood that several variants of the regulation method can be considered within the context of the invention.

The central point of the invention relates to the arrangement of the regulation module so that a first braking pulse and a second braking pulse can be generated, if necessary, in each positive half-period (first embodiment) or in each half-period (second embodiment) of the voltage induced between the terminals of the stator of the generator, without disturbing the function of electrical energy source of the generator to recharge a power supply circuit of the regulation circuit and without preventing the detection of successive zero crossings of the induced voltage signal, detection useful for measuring the angular speed of the rotor and therefore its frequency (number of revolutions per second) and also for triggering, optionally with a small time phase shift, the first braking pulses.

The invention claimed is:

1. A horological movement comprising a barrel, an analogue time display mechanism and a regulator module for regulating the running of the analogue display mechanism comprising a continuously rotating generator and a regulation circuit, the generator being formed of a rotor with permanent magnets rotated by the barrel and comprising at least one coil, forming a stator, which is connected to the regulation circuit, which is arranged to be able to regulate the average frequency of rotation of the rotor; the horological movement comprising a power supply circuit connected to said at least one coil and intended to supply power to the regulation circuit, said power supply circuit comprising a rectifier for rectifying the induced alternating voltage and a power supply capacity which is recharged, by the voltage induced via the rectifier, during charging periods in each of which said induced voltage reaches a peak value; the regulation circuit being arranged to be able to measure the rotation of the rotor over time and thus detect a drift in the average frequency of rotation of the generator relative to a set frequency, determined by an electronic oscillator associated with the regulation circuit, and/or a variation in the frequency of rotation, and to be able to generate braking pulses of the rotor by momentarily reducing the impedance at the terminals of said at least one coil, so as to brake the rotor according to said drift and/or said variation to regulate the speed of rotation of the generator and thus the operation of the analogue display mechanism; the regulation circuit being arranged to be able to detect a zero crossing of an induced alternating voltage generated in said at least one coil by the rotating rotor and to generate first braking pulses which are each triggered after a detection of the zero crossing of the induced voltage, the duration of each first braking pulse being scheduled so that it ends before the induced alternating voltage reaches the peak value after the zero crossing used to trigger said first braking pulse; wherein the regulation circuit is arranged so as to be able to further generate second braking pulses which are each triggered after a detection of the end of one of the charging periods of the power supply capacity and each of which has a duration scheduled for each second braking pulse to end before the induced alternating voltage crosses zero.

2. The horological movement according to claim 1, wherein each first braking pulse is provided so that it ends before the induced alternating voltage becomes equal, in absolute value, to a power supply voltage of the power supply capacity.

3. The horological movement according to claim 1, wherein the rectifier comprises at least one active diode which is formed of a transistor and a comparator the output of which controls the transistor, said active diode being arranged by construction so as to be conductive when the input voltage is greater than the output voltage increased by a predetermined threshold voltage, and so that when said active diode is conductive, the voltage drop across the transistor is greater than the threshold voltage.

4. The horological movement according to claim 3, wherein the regulation circuit comprises a circuit for detecting charging periods during which said active diode is conductive and the generator recharges the power supply capacity, said detection circuit providing a digital detection signal on the state of said active diode to a control unit which manages the impedance at the terminals of the stator, said control unit being arranged to be able to trigger a second braking pulse as soon as the digital detection signal has a transition indicating the end of one of said charging periods.

5. The horological movement according to claim 4, wherein the regulation circuit comprises a switch between the terminals of said at least one coil, said switch being controlled by the control unit which closes the switch during distinct time intervals in order to generate the braking pulses by short-circuiting.

* * * * *